US006917151B2

(12) United States Patent
Kimiya et al.

(10) Patent No.: US 6,917,151 B2
(45) Date of Patent: Jul. 12, 2005

(54) RESISTOR FOR ELECTRON GUN ASSEMBLY, ELECTRON GUN ASSEMBLY, AND CATHODE-RAY TUBE

(75) Inventors: Junichi Kimiya, Tokyo (JP); Shigeru Sugawara, Tokyo (JP); Takahiro Hasegawa, Tokyo (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 10/933,541

(22) Filed: Sep. 3, 2004

(65) Prior Publication Data

US 2005/0023953 A1 Feb. 3, 2005

Related U.S. Application Data

(63) Continuation of application No. PCT/JP03/16368, filed on Dec. 19, 2003.

(30) Foreign Application Priority Data

Dec. 20, 2002 (JP) ..... 2002-370516

(51) Int. Cl.[7] ..... H01J 29/48

(52) U.S. Cl. ..... 313/441; 313/449; 313/450; 313/456; 313/417; 338/308; 338/314

(58) Field of Search ..... 313/441, 409, 313/417, 446, 448–450, 456, 458; 315/3, 51; 338/308, 314

(56) References Cited

U.S. PATENT DOCUMENTS 4,786,842 A * 11/1988 Shimoma et al. ..... 315/3
5,914,559 A * 6/1999 Muchi et al. ..... 313/479
6,356,021 B2 * 3/2002 Irikura et al. ..... 315/3
6,570,330 B2 * 5/2003 Nagamachi et al. ..... 315/3

FOREIGN PATENT DOCUMENTS

| | | |
|---|---|---|
| JP | 2-267839 | 11/1990 |
| JP | 4-184847 | 7/1992 |
| JP | 6-65002 | 8/1994 |
| JP | 7-134952 | 5/1995 |
| JP | 9-17352 | 1/1997 |
| JP | 11-213910 | 8/1999 |

* cited by examiner

*Primary Examiner*—Ashok Patel
(74) *Attorney, Agent, or Firm*—Oblon, Spivak, McClelland, Maier & Neustadt, P.C.

(57) ABSTRACT

A resistor for an electron gun assembly is configured to apply a voltage, which is divided with a predetermined resistance division ratio, to an electrode provided in the electron gun assembly. The resistor includes an insulating substrate, an electrode element provided in association with each of a plurality of terminal portions on the insulating substrate, a resistor element having a pattern for connecting the electrode elements and obtaining a predetermined resistance value, and an insulating coating layer that covers the resistor element. In at least one terminal portion B, the electrode element is disposed spaced apart from the insulating coating layer, and an intermediate resistor element is disposed between the electrode element and the insulating coating layer. The intermediate resistor element has a resistance value that is different from a resistance value of the electrode element.

7 Claims, 3 Drawing Sheets

RESISTOR FOR ELECTRON GUN ASSEMBLY, ELECTRON GUN ASSEMBLY, AND CATHODE-RAY TUBE

CROSS-REFERENCE TO RELATED APPLICATIONS

This is a Continuation Application of PCT Application No. PCT/JP03/16368, filed Dec. 19, 2003, which was published under PCT Article 21(2) in Japanese.

This application is based upon and claims the benefit of priority from prior Japanese Patent Application No. 2002-370516, filed Dec. 20, 2002, the entire contents of which are incorporated herein by reference.

BACKGROUND OF THE INVENTION

1. Field of the Invention

The present invention relates to a resistor for an electron gun assembly that is mounted in a cathode-ray tube, and more particularly to a resistor for an electron gun assembly, the resistor being configured to apply a voltage, which is divided with a predetermined resistance division ratio, to a grid electrode provided in the electron gun assembly, an electron gun assembly with the resistor for an electron gun assembly, and a cathode-ray tube with the electron gun assembly.

2. Description of the Related Art

In recent years, there is an increasing demand for the advent of a cathode-ray tube capable of displaying a high-resolution color image. A beam spot size that is a major factor for determining resolution is determined by the focusing performance of an electron gun assembly that is mounted in the cathode-ray tube. In general terms, the focusing performance is determined by an aperture of a main lens, a virtual object point size, a magnification, etc. In other words, as the aperture of the main lens increases, as the virtual object point size decreases and as the magnification decreases, the size of a beam spot that is formed on a phosphor screen can be reduced and the resolution can be increased.

The electron gun assembly that is required to have such a good focusing performance is provided with various grid electrodes, which are supplied with relatively high voltages, in addition to an anode that is supplied with an anode voltage. As regards the cathode-ray tube with this structure, a problem of withstand voltage arises if high voltages are applied to the respective grid electrodes from a stem section of the cathode-ray tube.

To solve the problem, a resistor for dividing a voltage (an electron gun assembly resistor) is incorporated along with the electron gun assembly in the cathode-ray tube. The electron gun assembly resistor divides an anode voltage with a predetermined resistance division ratio. Desired high voltages, which are divided by the electron gun assembly resistor, are applied to predetermined grid electrodes (see, e.g. Jpn. Pat. Appln. KOKAI Publication No. 09-017352).

The electron gun assembly resistor includes, on an insulating substrate, an electrode element formed of a low-resistance material, and a resistor element formed of a high-resistance material that is basically similar to the material of the electrode element. A part of the electrode element and the resistor element are coated with an insulating coating layer. A terminal portion that is formed of a metal terminal is electrically connected to the electrode element. The terminal portion is fixed by calking to a through-hole that is formed in the insulating substrate.

However, in some cases, there arise various problems with the cathode-ray tube in which the above-described resistor is disposed.

For example, in order to improve withstand voltage characteristics, the cathode-ray tube, to which the above-mentioned high voltages are applied, is subjected to a withstand voltage process after an evacuation process in the fabrication steps. In the withstand-voltage process, a high voltage, which has a peak voltage about twice or thrice as high as a normal operation voltage, is applied to the cathode-ray tube. This causes a forcible discharge and removes burr or attached matter from the various grid electrodes, which may lead to deterioration in withstand-voltage characteristics.

A surface creepage, which occurs when the withstand voltage process is performed, progresses along the surface of the insulating coating layer of the resistor. Consequently, a discharge current may flow to a resistor element or an electrode element that lies under the insulating coating layer, leading to dielectric breakdown. Further, at the same time as the dielectric breakdown, the insulating coating layer that is in contact with the electrode element may be damaged. Moreover, matter that has peeled off the resistor and dropped floats within the cathode-ray tube and may clog the apertures of the shadow masks. In some cases, the resistor element, which is connected to the electrode element, may be damaged and, at last, line breakage may occur in the resistor element.

Such problems may be solved to some extent by relaxing conditions for the withstand voltage process, or properly controlling conditions for the withstand voltage process. However, a problem of degradation in focusing performance due to glow discharge, which is to be described below, is a very serious one for the cathode-ray tube that is required to have a high resolution.

To be more specific, while the cathode-ray tube is in operation, a glow discharge may occur, which originates from an edge of an electrode element that adjoins a ceramic insulating substrate, or from an exposed ceramic portion, and extends toward the high-voltage side. Such a glow discharge supplies an unnecessary current into the resistor. In other words, an excess current flows to the grid electrode, which is supplied with a voltage via the resistor, and a voltage, which is divided at a predetermined resistance division ratio, cannot stably be supplied. Consequently, such a phenomenon causes a focusing defect of an electron beam that is focused on the phosphor screen, and degrades the quality of an image that is displayed on the cathode-ray tube.

It may be thought that such a phenomenon of glow discharge occurs due to charge-up of an exposed ceramic part with a high secondary-electron emission coefficient. It is thus proposed that the exposed ceramic part is coated with an insulating coating layer, thereby suppressing occurrence of glow discharge.

However, if the exposed ceramic part is coated with the insulating coating layer, the above-mentioned dielectric breakdown due to the discharge current at the time of the withstand voltage process may easily occur at, or near, an overlapping part where the coated insulating coating layer contacts the electrode element. As a result, peeling of the insulating coating layer occurs, and such a defect as clogging of holes in the shadow mask may occur.

BRIEF SUMMARY OF THE INVENTION

The present invention has been made in consideration of the above-described problems, and its object is to provide a highly reliable electron gun assembly resistor, an electron gun assembly including the electron gun assembly resistor, and a cathode-ray tube including the electron gun assembly, which can prevent damage even when a high voltage is applied.

According to a first aspect of the present invention, there is provided a resistor for an electron gun assembly, the resistor being configured to apply a voltage, which is divided with a predetermined resistance division ratio, to an electrode that is provided in the electron gun assembly, comprising:

an insulating substrate;

a first resistor element provided in association with each of a plurality of terminal portions on the insulating substrate;

a second resistor element having a pattern for connecting the first resistor elements and obtaining a predetermined resistance value;

an insulating coating layer that covers the second resistor element; and metal terminals that are connected to the associated first electrode elements, wherein in at least one of the terminal portions, the first resistor element is disposed spaced apart from the insulating coating layer, and a third resistor element is disposed between the first resistor element and the insulating coating layer, and the third resistor element has a resistance value that is different from a resistance value of the first resistor element.

In another form of the resistor, the third resistor element may have the resistance value between the resistance value of the first resistor element and the resistance value of the insulating coating layer.

According to a second aspect of the present invention, there is provided an electron gun assembly comprising:

an electron beam generating section that generates an electron beam;

an electron lens section that focuses the electron beam generated from the electron beam generating section; and a resistor for the electron gun assembly, the resistor being configured to apply a voltage, which is divided with a predetermined resistance division ratio, to at least one of electrodes that constitute the electron beam generating section and the electron lens section, the resistor for the electron gun assembly comprising:

an insulating substrate;

a first resistor element provided in association with each of a plurality of terminal portions on the insulating substrate;

a second resistor element having a pattern for connecting the first resistor elements and obtaining a predetermined resistance value;

an insulating coating layer that covers the second resistor element; and metal terminals that are connected to the associated first electrode elements, wherein in at least one of the terminal portions, the first resistor element is disposed spaced apart from the insulating coating layer, and a third resistor element is disposed between the first resistor element and the insulating coating layer, and the third resistor element has a resistance value that is different from a resistance value of the first resistor element.

In another form of the electron gun assembly, the third resistor element may have the resistance value between the resistance value of the first resistor element and the resistance value of the insulating coating layer.

According to a third aspect of the present invention, there is provided a cathode-ray tube comprising:

an envelope including a panel having an inner surface on which a phosphor screen is disposed; and an electron gun assembly that is disposed within the envelope and emits an electron beam toward the phosphor screen, the electron gun assembly including a resistor for the electron gun assembly, the resistor being configured to apply a voltage, which is divided with a predetermined resistance division ratio, to at least one electrode, the resistor for the electron gun assembly comprising:

an insulating substrate;

a first resistor element provided in association with each of a plurality of terminal portions on the insulating substrate;

a second resistor element having a pattern for connecting the first resistor elements and obtaining a predetermined resistance value;

an insulating coating layer that covers the second resistor element; and metal terminals that are connected to the associated first electrode elements, wherein in at least one of the terminal portions, the first resistor element is disposed spaced apart from the insulating coating layer, and a third resistor element is disposed between the first resistor element and the insulating coating layer, and the third resistor element has a resistance value that is different from a resistance value of the first resistor element.

In another form of the cathode-ray tube, the third resistor element may have the resistance value between the resistance value of the first resistor element and the resistance value of the insulating coating layer.

According to the above-described electron gun assembly resistor, in at least one of the terminal portions, the first resistor element (electrode element) is disposed spaced apart from the insulating coating layer, and a third resistor element (intermediate resistor element) is disposed between the first resistor element and the insulating coating layer, and the third resistor element has a resistance value that is different from a resistance value of the first resistor element. In short, the first resistor element and the third resistor element completely cover the insulating substrate, which may become an origin of a discharge phenomenon, and the insulating substrate is not exposed.

Even in a case where a high voltage is applied in a high vacuum, it is possible to suppress emission of secondary electrons, which occurs when scattering electrons that float in the tube impinge upon the insulating substrate, and to suppress charge-up of the insulating substrate. Thereby, occurrence of a discharge phenomenon can be suppressed, and the reliability of the resistor can be enhanced.

With the above-described structure, it becomes possible to prevent dielectric breakdown of the insulating coating layer due to discharge current at the time of a withstand voltage process, and thus peeling of the insulating coating layer can be prevented. Specifically, the peripheral region of the terminal portion is composed of the first resistor elements third resistor element and insulating coating layer, which have resistance values that increase stepwise. Thereby, dielectric breakdown, which occurs at a region where the resistance value changes greatly, can be prevented. As a result, such a defect as clogging of holes in the shadow mask due to the peeled-off insulating coating layer can be avoided.

The above-described electron gun assembly includes the resistor that can suppress occurrence of a discharge phenomenon. Therefore, it becomes possible to stably supply voltages, which are divided with a predetermined resistance division ratio, to the grid electrodes that are supplied with voltages via the resistor, and a good focusing performance can be maintained.

Furthermore, the above-described cathode-ray tube includes the electron gun assembly that can maintain a good focusing performance. Therefore, the size of a beam spot that is formed on the phosphor screen can be reduced, and a high-resolution, high-quality image can be displayed.

DETAILED DESCRIPTION OF THE INVENTION

A resistor for an electronic gun assembly according to an embodiment of the present invention, an electron gun assembly and a cathode-ray tube will now be described with reference to the accompanying drawings.

Figure 1:
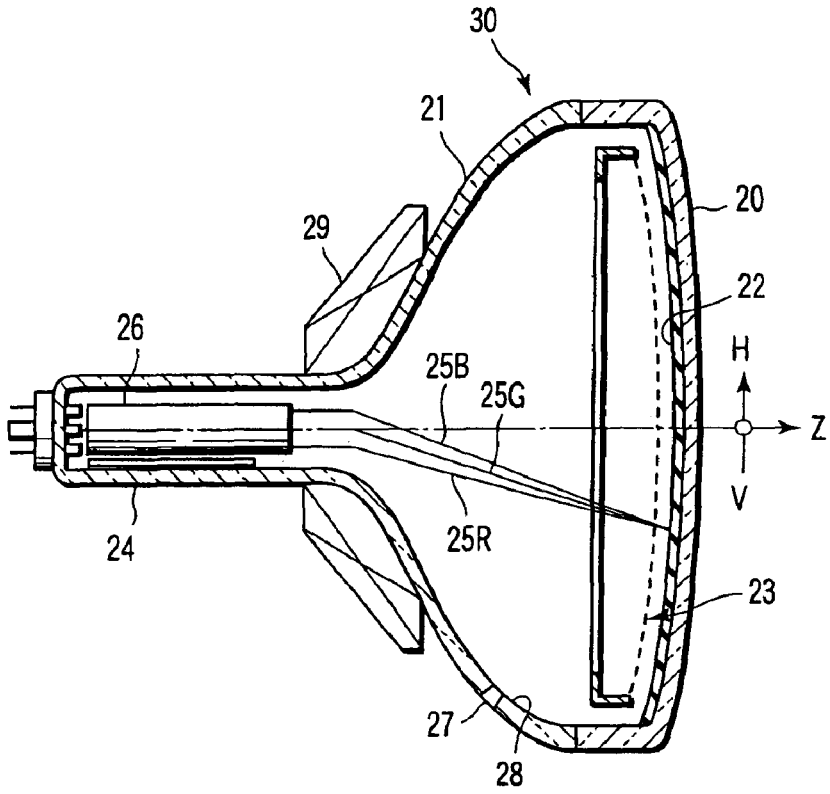
FIG. 1 schematically shows the structure of a color cathode-ray tube apparatus according to an embodiment of the present invention.

As is shown in FIG. 1, a color cathode-ray tube apparatus, which is an instance of a cathode-ray tube apparatus, has a vacuum envelope 30. The vacuum envelope 30 includes a panel 20 and a funnel 21 that is integrally coupled to the panel 20. A phosphor screen (target) 22 is disposed on an inside surface of the panel 20. The phosphor screen 22 has three-color striped or dot-shaped phosphor layers, which emit blue, green and red light. A shadow mask 23 is disposed to face the phosphor screen 22. The shadow mask 23 has many apertures in its inside part.

An electron gun assembly 26 is disposed within a cylindrical neck 24, which corresponds to a thinnest portion of the funnel 21. The electron gun assembly 26 emits three electron beams 25B, 25G and 25R toward the phosphor screen 22 in a tube-axis direction, that is, in a Z-axis direction. These three electron beams that are emitted from the electron gun assembly 26 comprise a center beam 25G and a pair of side beams 25B and 25R, which are arranged in line in the same horizontal plane, that is, in an H-axis direction.

An anode terminal 27 is provided on the funnel 21. An inside electrically conductive film 28 of graphite is formed on the inner surface of the funnel 21. A deflection yoke 29 is disposed on the outside of the funnel 21. The deflection yoke 29 generates non-uniform deflection magnetic fields for deflecting the three electron beams 25B, 25G and 25R, which have been emitted from the electron gun assembly 26. The deflection yoke 29 includes a horizontal deflection coil that generates a pincushion-shaped horizontal deflection magnetic field, and a vertical deflection coil that generates a barrel-shaped vertical deflection magnetic field.

In the color cathode-ray tube apparatus with the above-described structure, the three electron beams 25B, 25G and 25R emitted from the electron gun assembly 26 are self-converged and focused on the associated color phosphor layers on the phosphor screen 22. The three electron beams 25B, 25G and 25R are deflected by the non-uniform deflection magnetic fields generated by the deflection yoke 29 and scanned over the phosphor screen 22 in the horizontal direction H and vertical direction V. Thus, a color image is displayed on the phosphor screen 22.

Figure 2:
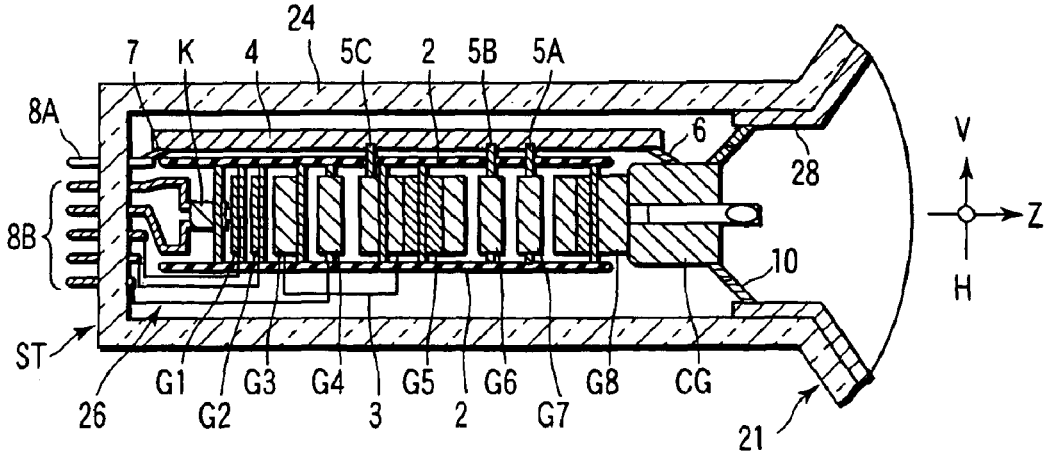
FIG. 2 schematically shows the structure of an electron gun assembly that is applied to the color cathode-ray tube apparatus shown in FIG. 1.

As is shown in FIG. 2, the electron gun assembly 26 includes three cathodes K (B, G, R) that are arranged in line in the horizontal direction H, and a plurality of electrodes that are arranged coaxially in the tube-axis direction Z. The plural electrodes, that is, a first grid electrode G1, a second grid electrode G2, a third grid electrode G3, a fourth grid electrode G4, a fifth grid electrode (focus electrode) G5, a sixth grid electrode (first intermediate electrode) G6, a seventh grid electrode (second intermediate electrode) G7, an eighth grid electrode (anode electrode) G8 and a convergence electrode CG, are coaxially arranged in succession from the cathode K (R, G, B) side toward the phosphor screen 22.

The three cathodes K (B, G, R) and the first to eighth grid electrodes G1 to G8 are clamped between, and integrally held by, a pair of insulating support members, i.e. bead glasses 2, such that they maintain a predetermined mutual positional relationship. The convergence electrode CG is welded to, and electrically connected to, the eighth grid electrode G8.

Each of the first grid electrode G1 and second grid electrode G2 is formed of a relatively thin plate electrode. The third grid electrode G3, fourth grid electrode G4, fifth grid electrode G5 and eighth grid electrode G8 comprise integrally formed cylindrical electrodes that are formed by abutting a plurality of cup-shaped electrodes upon each other. The sixth grid electrode G6 and seventh grid electrode G7 comprise relatively thick plate electrodes. Each of the grid electrodes has three electron beam passage holes for passing three electron beams, the passage holes being arranged in association with the three cathodes K (R, G, B).

A resistor 4 for the electron gun assembly is disposed in the vicinity of the electron gun assembly 26. The resistor 4 divides a high voltage with a predetermined resistance division ratio in association with the grid electrodes of the electron gun assembly 26. The voltages divided by the resistor 4 are applied to the respective grid electrodes.

One end portion of the resistor 4 is connected to the convergence electrode CG via a lead-out terminal 6. The other end portion of the resistor 4 is connected to a stem pin 8A via a lead-out terminal 7. Stem pins 8A and 8B penetrate a stem section ST that seals the end of the neck in the state in which the inside of the vacuum envelope is kept airtight. The stem pins 8A and 8B are grounded directly or grounded via a variable resistor on the outside of the tube. An intermediate portion of the resistor 4 is provided with three lead-out terminals 5A, 5B and 5C in the named order from the one end side. The lead-out terminals 5A, 5B and 5C are electrically connected to the seventh grid electrode G7, sixth grid electrode G6 and fifth grid electrode G5, respectively.

The cathodes K (R, G, B) and grid electrodes of the electron gun assembly 26 are supplied with predetermined voltages via the stem pins 8B. Specifically, the cathodes K (R, G, B) are supplied with a voltage that is obtained by superimposing an image signal on a DC voltage of about 190 V. The first grid electrode G1 is grounded. A DC voltage of about 800 V is applied to the second grid electrode G2. The third grid electrode G3 and fifth grid electrode G5 are electrically connected via a conductor line 3 within the tube. The fourth grid electrode G4 is supplied with a dynamic focus voltage that is obtained by superimposing an AC component voltage, which varies parabolically in synchronism with deflection of the electron beam, on a DC voltage of about 8 to 9 kV.

The eighth grid electrode G8 is supplied with an anode voltage of about 30 kV. Specifically, the convergence electrode CG that is welded to the eighth grid electrode G8 is provided with a plurality of conductor springs 10 that are put in pressure contact with the inside electrically conductive film 28. The anode voltage is applied to the convergence electrode CG and eighth grid electrode G8 via the anode terminal 27 provided on the funnel 21, the inside electrically conductive film 28 and conductor springs 10.

The anode voltage is supplied to the resistor 4 via the lead-out terminal 6 that is electrically connected to the convergence electrode CG. Predetermined voltages, which are divided with a predetermined resistance division ratio, are applied to the seventh grid electrode G7, sixth grid electrode G6 and fifth grid electrode G5 via the lead-out terminals 5A, 5B and 5C of the resistor 4.

The respective grid electrodes of the electron gun assembly 26 are supplied with the above-described voltages. Thus, the cathodes K (B, G, R), first grid G1 and second grid G2 form an electron beam generating section that generates electron beams. The second grid electrode G2 and third grid electrode G3 form a prefocus lens that prefocuses the electron beams generated from the electron beam generating section.

The third grid electrode G3, fourth grid electrode G4 and fifth grid electrode G5 form a sub-lens that further focuses the electron beams, which have been prefocused by the prefocus lens. The fifth grid electrode G5, sixth grid electrode G6, seventh grid electrode G7 and eighth grid electrode G8 form a main lens that ultimately focuses the electron beams, which have been prefocused by the sub-lens, on the phosphor screen 22.

The structure of the electron gun assembly resistor 4 is described in greater detail.

Figure 3:
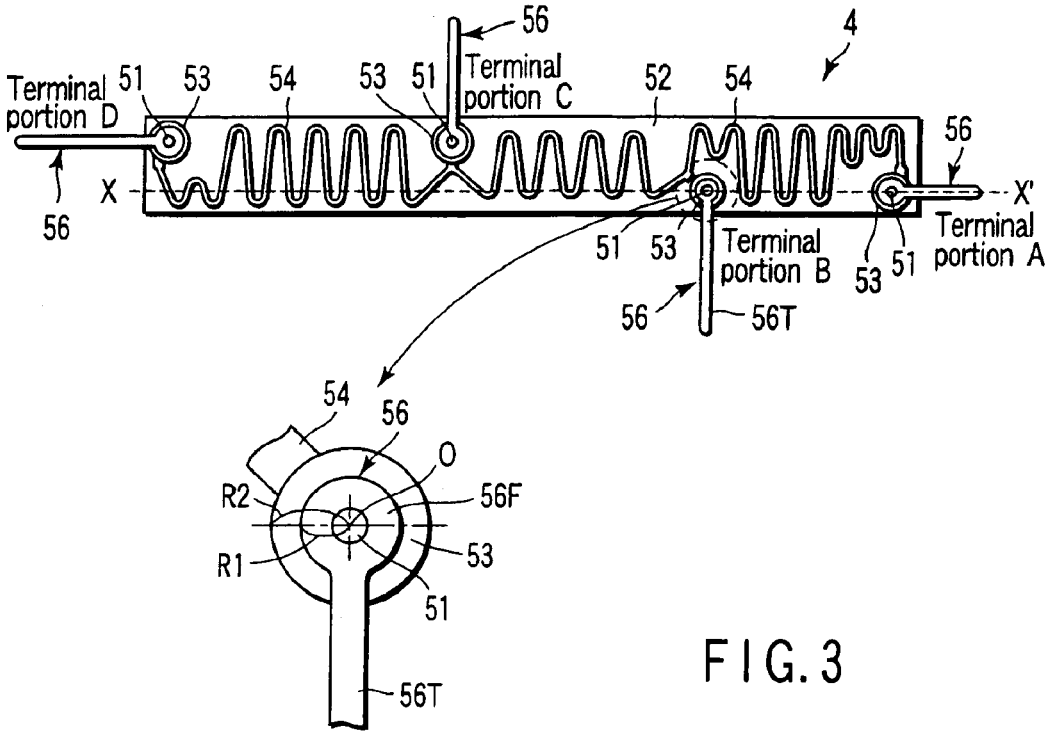
FIG. 3 shows an electron gun assembly resistor, which is applied to the electron gun assembly shown in FIG. 2, in a state in which the resistor is seen through an insulating coating layer that forms an outer surface part of the resistor.
Figure 4:
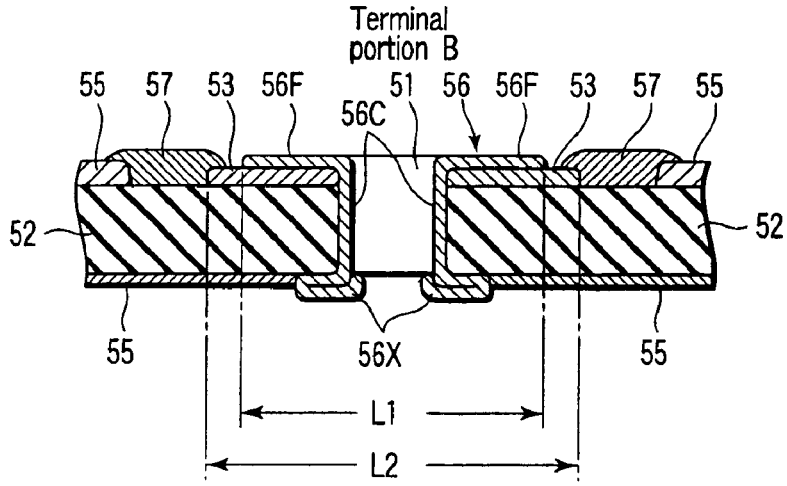
FIG. 4 is a cross-sectional view taken along line X—X in FIG. 3, which schematically shows a cross-sectional structure of a part near a terminal portion B in the electron gun assembly resistor shown in FIG. 3.

As is shown in FIG. 3 and FIG. 4, the resistor 4 comprises an insulating substrate 52; a plurality of first resistor elements, that is, a plurality of electrode elements 53, which are provided in association with a plurality of terminal portions on the insulating substrate 52; a second resistor element, that is, a resistor element 54, which has a pattern for connecting the electrode elements and obtaining a predetermined resistance value; an insulating coating layer 55 that covers the resistor element 54; and a plurality of metal terminals 56 that are connected to the associated electrode elements 53.

The insulating substrate 52 is formed of a ceramic-based sheet-like material that is essentially composed of, e.g. aluminum oxide. The insulating substrate 52 has a plurality of preformed through-holes 51 that penetrate the insulating substrate 52 from the upper side to the lower side at predetermined positions for formation of the terminal portions.

The electrode elements 53 are formed of a relatively low resistance material (e.g. a low resistance paste material with a sheet resistance value of 10 kΩ/□) that includes, e.g. a metal oxide such as ruthenium oxide, or a glass material such as borosilicate lead glass. The electrode elements 53 are disposed at predetermined positions on the surface of the insulating substrate 52. To be more specific, the electrode elements 53 are disposed in an insular shape at the terminal portions A to D of the insulating substrate 52 so as to correspond to the associated through-holes 51 formed in the insulating substrate 52.

The resistor element 54 is formed of a material that includes, e.g. a glass material such as borosilicate lead glass and a relatively higher resistance than the electrode element 53 (e.g. a high resistance paste material with a sheet resistance value of 5 MΩ/□). The resistor element 54 is disposed on the surface of the insulating substrate 52 so as to have a predetermined pattern, e.g. a wavy pattern, and it is electrically connected to the respective electrode elements 53. The length, width and thickness of the resistor element 54 are set such that a predetermined resistance value is obtained between the electrode elements 53.

The insulating coating layer 55 is formed of a relatively high resistance material that is essentially composed of, e.g. a transition metal oxide or borosilicate lead glass. The insulating coating layer 55 is disposed so as to cover the upper surface of the insulating substrate 52, which includes the resistor element 54 but excludes portions of the electrode elements 53, and also to cover the lower surface of the insulating substrate 52. With the disposition of the insulating coating layer 55, the withstand voltage characteristics of the resistor 4 are improved.

Each metal terminal 56 includes a flange portion 56F that is provided at one end thereof, a tongue-like terminal portion 56T that extends from the flange portion 56F, and a cylindrical portion 56C that is continuous with the flange portion 56F. The metal terminal 56 is attached in the following manner. The cylindrical portion 56C is inserted in the through-hole 51 from the upper surface side of the insulating substrate 52, and a distal end portion 56X of the cylindrical portion 56C, which projects from the lower surface of the insulating substrate 52, is calked. Thus, each metal terminal 56 clamps the associated electrode element 53 between its flange portion 56F and the insulating substrate 52, and is electrically connected to the electrode element 53. In this manner, the terminal portions A to D are formed.

The terminal portion A is connected to the lead-out terminal 6 via the metal terminal 56 and is supplied with a highest voltage, i.e. an anode voltage. The terminal portion D is connected to the lead-out terminal 7 via the metal terminal 56 and is supplied with a lowest voltage (for example, the terminal portion D is grounded). The terminal portion B is connected to, e.g. the lead-out terminal 5A via the metal terminal 56 and is supplied with a second highest voltage next to the voltage applied to the terminal portion A. The terminal portion C is connected to, e.g. the lead-out terminal 5B via the metal terminal 56 and is supplied with a third highest voltage next to the voltage applied to the terminal portion B. In the example shown in FIG. 3, a terminal portion that is connected to the lead-out terminal 5C is not shown for the purpose of simple description. It is possible to provide such a terminal portion between the terminal portion C and terminal portion D.

In at least one of the terminal portions, the electrode element 53 is disposed spaced apart from the insulating coating layer 55. In an example shown in FIG. 4, in the terminal portion B, the electrode element 53 is not covered with the insulating coating layer 55. In addition, an intermediate resistor element 57 serving as a third resistor element is disposed between the electrode element 53 and insulating coating layer 55.

The intermediate resistor element 57 has a resistance value that is different from the resistance value of the electrode element 53. Specifically, the intermediate resistor element 57 is formed of an intermediate resistance material, which has a resistance value that is higher than the resistance value of the electrode element 53 and is lower than the resistance value of the insulating coating layer 55.

The intermediate resistor element 57 is disposed so as to partially overlap the electrode element 53 and insulating coating layer 55. Specifically, an outside dimension L2 of the electrode element 53 is greater than an outside dimension L1 of the flange portion 56F of the metal terminal 56 that is in contact with the electrode element 53. Thereby, the electrode element 53 extends outward from the outer edge of the flange portion 56F. The intermediate resistor element 57 overlaps a peripheral portion of the electrode element 53, without contacting the flange portion 56F of the metal terminal 56. In addition, the intermediate resistor element 57 overlaps the insulating coating layer 55 that covers the entirety except a region near the electrode element 53. Thus, the insulating substrate 52 near the terminal portion is not exposed and is covered with the electrode element 53, insulating coating layer 55 and intermediate resistor element 57.

In the example shown in FIG. 3 and FIG. 4, the flange portion 56F of the metal terminal 56 is formed in a doughnut shape with a first radius R1 from the center O of the through-hole 51. On the other hand, the electrode element 53 is formed in a doughnut shape with a second radius R2 that is greater than the first radius R1 from the center O of the through-hole 51. Thus, the peripheral portion of the electrode element 53 is exposed, without overlapping the flange portion 56F. In this state, a region between the substantially entire periphery of the electrode element 53 and the insulating coating layer 55 is covered with the intermediate resistor element 57. Thereby, the surface of the insulating substrate 52 is completely covered.

Next, a method of manufacturing the above-described resistor 4 is described.

To begin with, an insulating substrate 52 in which through-holes 51 are formed in advance at predetermined positions is prepared. A low-resistance paste material is coated over the insulating substrate 52 by screen printing. A screen that is used in the screen printing has such a pattern as to form doughnut-shaped electrode elements 53 in insular shapes in association with the respective through-holes 51. The coated low-resistance paste material is dried and then baked. Thus, a plurality of electrode elements 53 are formed.

Then, a high-resistance paste material is coated over the insulating substrate 52 by screen printing. A screen that is used in this screen printing has a pattern that is connected to the insular electrode elements 53 and is so adjusted as to obtain a predetermined resistance value between the electrode elements 53. The coated high-resistance paste material is dried and then baked. Thus, a resistor element 54 is formed such that the entirety of the resistor 4 has a predetermined resistance value of, e.g. $0.1\times10^9$ to $2.0\times10^9$ Ω.

Then, an insulating coating layer 55 is coated on the entire insulating substrate 52 by screen printing so as to cover the resistor element 54, but not to cover parts of peripheral portions of the electrode elements 53. The insulating coating layer 55 is dried and then baked. Thus, in at least one of the terminal portions, the insulating coating layer 55 is spaced apart from the electrode element 53, and the insulating substrate 52 is exposed between the insulating coating layer 55 and the electrode element 53.

Subsequently, an intermediate-resistance paste material, which has a resistance value between the resistance value of the electrode element 53 and the resistance value of the insulating coating layer 55, is coated on the exposed part of the insulating substrate 52 by screen printing. A screen that is used in this screen printing has such a pattern as to overlap the peripheral part of the electrode element 53 and the peripheral part of the insulating coating layer 55. The coated intermediate-resistance paste material is dried and then baked. As a result, the exposed area of the insulating substrate 52 is reduced to nearly zero.

Following the above, the cylindrical portion 56C of the metal terminal 56 is inserted in the through-hole 51 from the upper surface side of the insulating substrate 52, and the distal end portion 56X that projects from the lower surface of the insulating substrate 52 is calked. Thereby, the flange portion 56F is electrically connected to the associated electrode element 53.

The resistor 4 for the electron gun assembly is completed through the above-described fabrication steps. The fabricated resistor 4 is fixed to the bead glasses 2 of the electron gun assembly 26, as shown in FIG. 2, and the terminal portions 56T of the metal terminals 56 disposed at the respective terminal portions are electrically connected to the associated grid electrodes. Thereby, voltages, which are obtained by dividing the anode voltage with a predetermined resistance division ratio, can stably be supplied to desired grid electrodes, and an electron gun assembly with a good focusing performance can be constructed.

In this description, the terminal portion B adopts the above-described structure. This structure, however, may be applied to other terminal portions. The intermediate resistor element 57 is formed after the formation of the electrode element 53 and insulating coating layer 55, but the order of formation is not limited to this.

Figure 5:
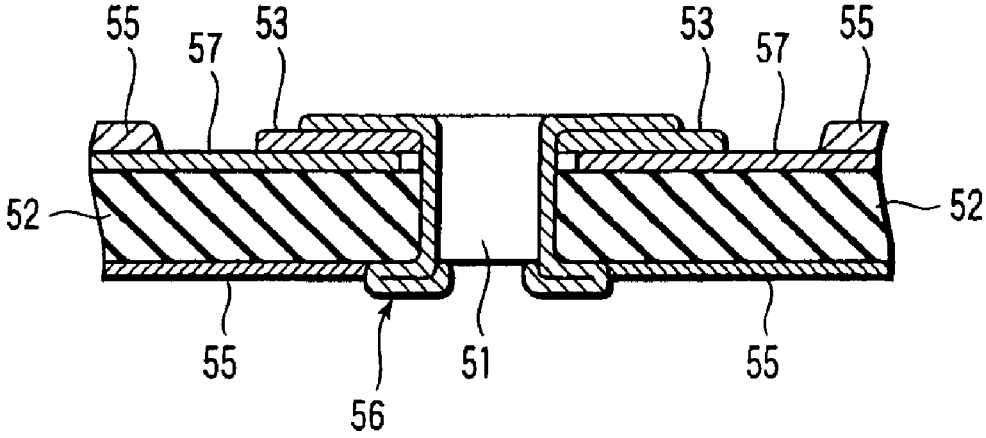
FIG. 5 schematically shows another cross-sectional structure of the electron gun assembly resistor that is applicable to the electron gun assembly shown in FIG. 2.

For example, as shown in FIG. 5, the intermediate resistor element 57 may first be formed, following which the electrode element 53 and insulating coating layer 55 may be formed in succession. In this case, the intermediate resistor element 57 may be disposed over the insulating substrate 52 on which the electrode element 53 is formed, or may be disposed only on the peripheral region of the terminal portion.

Figure 6:
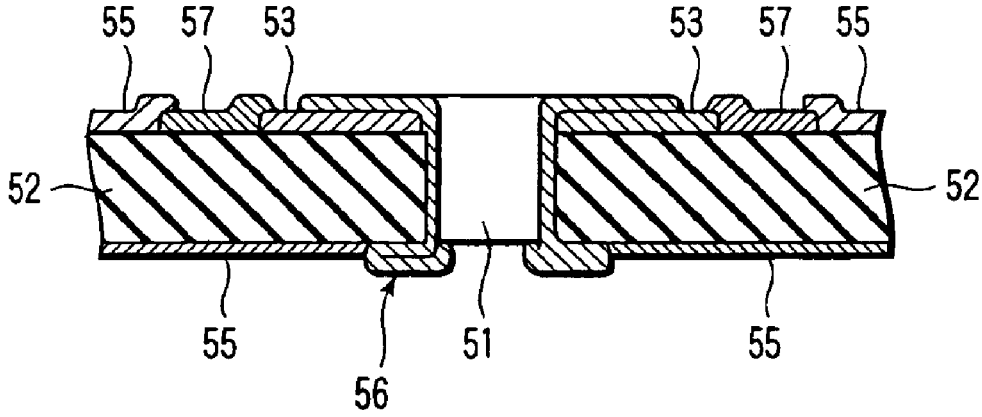
FIG. 6 schematically shows still another cross-sectional structure of the electron gun assembly resistor that is applicable to the electron gun assembly shown in FIG. 2.

Besides, as shown in FIG. 6, after formation of the electrode element 53, the intermediate resistor element 57 may be formed so as to overlap the peripheral part of the electrode element 53. Then, the insulating coating layer 55 may be formed so as to overlap the peripheral part of the intermediate resistor element 57.

In short, in any of the examples shown in FIG. 4 to FIG. 6, it should suffice if the intermediate resistor element 57 is disposed to overlap at least parts of the electrode element 53 and insulating coating layer 55, thereby to reduce the exposed area of the insulating substrate 52 to zero, and the order of formation is not limited to that described in each of the examples.

With the electron gun assembly including the resistor 4 having the above-described structure, the problems with conventional electron gun assemblies can be solved. In the electron gun assembly, the terminal portion B, which is positioned near a location of an anode voltage, is in such a state that electrons tend to be drawn by a permeating voltage from the anode and to be easily emitted. In addition, in the case where that part of the insulating substrate, which is located between the electrode element of the terminal portion B and the insulating coating layer, is exposed, floating electrons, which leak from the low-voltage section, impinge upon exposed part. As a result, secondary electrons are emitted from the insulating substrate.

Owing to such a phenomenon of emission of secondary electrons, etc., the surface of the insulating substrate is charged up. This induces leak electrons from the metal terminal, electrode element, etc., resulting in production of a glow discharge. Consequently, excess current flows into the electron gun assembly resistor, and it becomes impossible to supply desired potentials to the grid electrodes that are connected to the terminal portions B and C. As a result, a phenomenon such as defective focusing of the cathode-ray tube occurs.

By contrast, in the electron gun assembly resistor 4 with the structure described in the above embodiment, that part of the insulating substrate 52, which is located between the electrode element 53 and the insulating coating layer 55, is completely covered with the intermediate resistor element 57. Therefore, floating electrons from the low-voltage section can be prevented from impinging upon the insulating substrate 52.

Even in a case where a high voltage is applied in a high vacuum, emission of secondary electrons from the insulating substrate 52 is suppressed, and charge-up of the surface of the insulating substrate 52 and occurrence of an undesirable discharge can be suppressed. It becomes thus possible to prevent excess current from flowing into the electron gun assembly resistor 4 and to stably supply predetermined potentials to the grid electrodes that are connected to the terminal portions B and C. Therefore, defective focusing of electron beams, which are to be focused on the phosphor screen, can be prevented.

The electrode element 53, intermediate resistor element 57 and insulating coating layer 55 are arranged in the order of magnitude of their resistance values. Accordingly, in the vicinity of the terminal portion, the resistance value increases stepwise. Besides, the respective components are disposed so as to mutually overlap.

Thus, a gentle variation in resistance value can be provided from the metal terminal 56 to the insulating coating layer 55. Even in the withstand voltage process step provided in the manufacturing process of the cathode-ray tube, in which pulses of a high voltage, which is about twice or thrice higher than the anode potential, are applied to the anode electrode, it becomes possible to suppress peeling of the insulating coating layer 55, etc., due to dielectric breakdown between the insulating coating layer 55 and electrode element 53, which is caused by discharge current. Hence, such a defect as clogging of holes in the shadow mask due to peeled-off matter can be avoided. Therefore, a cathode-ray tube with very stable, excellent focusing characteristics can be manufactured.

As has been described above, according to the electron gun assembly resistor of this embodiment, it is possible to suppress occurrence of discharge, which becomes a problem, within the cathode-ray tube when a high voltage is applied, and to suppress clogging of holes in the shadow mask due to peeling of the electrode element or the insulating coating layer of the resistor. The industrial advantage of this technique is great, since voltages can stably be supplied within the cathode-ray tube and a highly reliable electron gun assembly resistor can be obtained.

In the above embodiment, the resistor for the electron gun assembly is applied to the color cathode-ray tube apparatus. Needless to say, the resistor for the electron gun assembly, which has the above-described structure, is applicable to other electron tubes that require voltage-division resistors.

The present invention is not limited to the above-described embodiments. At the stage of practicing the invention, various modifications and alterations may be made without departing from the spirit of the invention. The embodiments may properly be combined and practiced, if possible. In this case, advantages are obtained by the combinations.

As has been described above, the present invention may provide a highly reliable electron gun assembly resistor, an electron gun assembly and a cathode-ray tube, which can prevent damage even when a high voltage is applied.

What is claimed is:

1. A resistor for an electron gun assembly, the resistor being configured to apply a voltage, which is divided with a predetermined resistance division ratio, to an electrode that is provided in the electron gun assembly, comprising:

an insulating substrate;

a first resistor element provided in association with each of a plurality of terminal portions on the insulating substrate;

a second resistor element having a pattern for connecting the first resistor elements and obtaining a predetermined resistance value;

an insulating coating layer that covers the second resistor element; and metal terminals that are connected to the associated first electrode elements, wherein in at least one of the terminal portions, the first resistor element is disposed spaced apart from the insulating coating layer, and a third resistor element is disposed between the first resistor element and the insulating coating layer, and the third resistor element has a resistance value that is different from a resistance value of the first resistor element.

2. The resistor for an electron gun assembly, according to claim 1, wherein a relationship, $A<C<B$, is established, where A is a resistance value of the first resistor element, B is a resistance value of the insulating coating layer, and C is a resistance value of the third resistor element.

3. The resistor for an electron gun assembly, according to claim 1, wherein the third resistor element is disposed to partially overlap the first resistor element and the insulating coating layer.

4. The resistor for an electron gun assembly, according to claim 1, wherein a relationship, $A<C<B$, is established, where A is a resistance value of the first resistor element, B is a resistance value of the insulating coating layer, and C is a resistance value of the third resistor element, and the third resistor element is disposed to partially overlap the first resistor element and the insulating coating layer.

5. The resistor for an electron gun assembly, according to claim 1, wherein the first resistor element has a greater outside dimension than the metal terminal, and extends outward from an outer edge of the metal terminal, and the third resistor element is disposed to overlap the first resistor element, without contacting the metal terminal.

6. An electron gun assembly comprising:

an electron beam generating section that generates an electron beam;

an electron lens section that focuses the electron beam generated from the electron beam generating section; and a resistor for the electron gun assembly, the resistor being configured to apply a voltage, which is divided with a predetermined resistance division ratio, to at least one of electrodes that constitute the electron beam generating section and the electron lens section, the resistor for the electron gun assembly comprising:

an insulating substrate;

a first resistor element provided in association with each of a plurality of terminal portions on the insulating substrate;

a second resistor element having a pattern for connecting the first resistor elements and obtaining a predetermined resistance value;

an insulating coating layer that covers the second resistor element; and metal terminals that are connected to the associated first electrode elements, wherein in at least one of the terminal portions, the first resistor element is disposed spaced apart from the insulating coating layer, and a third resistor element is disposed between the first resistor element and the insulating coating layer, and the third resistor element has a resistance value that is different from a resistance value of the first resistor element.

7. A cathode-ray tube comprising:

an envelope including a panel having an inner surface on which a phosphor screen is disposed; and an electron gun assembly that is disposed within the envelope and emits an electron beam toward the phosphor screen, the electron gun assembly including a resistor for the electron gun assembly, the resistor being configured to apply a voltage, which is divided with a predetermined resistance division ratio, to at least one electrode, the resistor for the electron gun assembly comprising:

an insulating substrate;

a first resistor element provided in association with each of a plurality of terminal portions on the insulating substrate;

a second resistor element having a pattern for connecting the first resistor elements and obtaining a predetermined resistance value;

an insulating coating layer that covers the second resistor element; and metal terminals that are connected to the associated first electrode elements, wherein in at least one of the terminal portions, the first resistor element is disposed spaced apart from the insulating coating layer, and a third resistor element is disposed between the first resistor element and the insulating coating layer, and the third resistor element has a resistance value that is different from a resistance value of the first resistor element.

* * * * *